US006328249B1

(12) United States Patent
Ogawa et al.

(10) Patent No.: US 6,328,249 B1
(45) Date of Patent: Dec. 11, 2001

(54) ADJUSTABLE POSITION WEB SUPPLY MECHANISM FOR A ROTARY PRINTING PRESS

(75) Inventors: Yukio Ogawa, Kanagawa; Nobuaki Hashimoto, Tokyo, both of (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/512,808

(22) Filed: Feb. 25, 2000

(30) Foreign Application Priority Data

Apr. 23, 1999 (JP) ..... 11-116261

(51) Int. Cl.[7] ..... B65H 16/06; B65H 19/12; B65H 75/24

(52) U.S. Cl. ..... 242/559.2; 242/563; 242/573; 242/573.4; 242/592; 242/596.1

(58) Field of Search ..... 242/559.2, 533.4, 242/533.5, 533.6, 563, 563.1, 596.1, 573.4, 573, 559.1, 559.4, 578.1, 592

(56) References Cited

U.S. PATENT DOCUMENTS

| | | | | |
|---|---|---|---|---|
| 1,980,879 | | 11/1934 | Roesen . | |
| 2,177,577 | * | 10/1939 | Mikaelson | 242/573.4 |
| 2,298,759 | * | 10/1942 | Fouse | 242/573.4 |
| 2,499,562 | * | 3/1950 | Behrens | 242/559.1 |
| 3,326,487 | | 6/1967 | Huck . | |
| 4,102,511 | * | 7/1978 | Krimsky et al. | 242/533.4 |
| 4,693,433 | * | 9/1987 | Martin | 242/596.1 |
| 4,903,910 | * | 2/1990 | Tamura | 242/563 |
| 4,913,367 | * | 4/1990 | Hata | 242/563 |
| 5,241,906 | * | 9/1993 | Kansaku | 242/533.6 |
| 5,333,809 | * | 8/1994 | Berry et al. | 242/596.1 |
| 6,007,017 | * | 12/1999 | Vorwerk | 242/563 |
| 6,213,423 | * | 4/2001 | St. Germain et al. | 242/559.2 |

FOREIGN PATENT DOCUMENTS

| | | |
|---|---|---|
| 0 101 044 A1 | 2/1984 | (EP) . |
| 4-213543 | 8/1992 | (JP) . |
| 7-285709 | 10/1995 | (JP) . |

* cited by examiner

*Primary Examiner*—John M. Jillions
(74) *Attorney, Agent, or Firm*—Arent Fox Kintner Plotkin & Kahn

(57) ABSTRACT

At least two pairs of carrier arms are mounted to a rotary shaft for independent travel axially thereof while being constrained to joint rotation therewith. Each pair of carrier arms are disposed opposite each other axially of the shaft for rotatably holding one web roll therebetween via expansion chucks. An internally screw-threaded sleeve is rotatably mounted to each carrier arm and locked against axial displacement relative to the carrier arm. Rotatably supported on the shaft and extending parallel to its axis, a screw-threaded rod extends through, and is threadedly engaged with, the sleeves on each pair of carrier arms. A reversible electric motor is drivingly coupled to each threaded nut, and an additional similar motor to each threaded rod. Each pair of carrier arms are therefore not only independently movable toward and away from each other, as for chucking a web roll therebetween, but, together with the chucked web roll, jointly movable in either axial direction of the shaft for accurately positioning the web roll thereon.

13 Claims, 6 Drawing Sheets

ADJUSTABLE POSITION WEB SUPPLY MECHANISM FOR A ROTARY PRINTING PRESS

BACKGROUND OF THE INVENTION

This invention relates to printing presses, to web-fed rotary presses, and to a web supply mechanism for such presses. More specifically, the invention deals with improved means in a web supply mechanism for rotatably holding two or more webs of paper or like printable material in roll form, featuring provisions for axially shifting web rolls of different widths or axial dimensions to, and rotatably holding them in, different preassigned working positions from which the webs are to be delivered to a printing section by being conventionally spliced one to the next.

Web supply mechanisms accommodating web rolls of different widths have been known and used extensively in conjunction with web-fed rotary printing presses. Among such known mechanisms are the one taught by U.S. Pat. No. 1,980,879. It suggests pairs of web roll carrier arms mounted to a rotary shaft in circumferentially spaced positions thereon, with each pair of carrier arms disposed opposite each other axially of the shaft for movement toward and away from each other. Each carrier arm has mounted thereto an internally screw-threaded sleeve for engagement with an externally threaded rod which is rotatably mounted to the shaft and which extends parallel to its axis. The two threaded rods, associated with each pair of carrier arms, are independently driven bidirectionally in order to adjust the spacing between the carrier arms to the width of the web roll to be mounted therebetween.

An objection to this prior art device is the absence of means for jointly moving each pair of carrier arms together with the web roll supported therebetween, in order to bring the web roll to the exact working position axially of the rotary shaft. Even though each carrier arm pair are simultaneously movable in the same direction by synchronous rotation of the threaded rods, they are not mechanically coupled together. Moving two mechanically unconnected parts by two separate drive means in exact synchronism may be possible but certainly is not practical.

U.S. Pat. No. 3,326,487 teaches another web supply mechanism comprising fixed carrier arms immovably mounted to a rotary shaft adjacent one end thereof, and movable carrier arms slidably mounted to the shaft for movement along its axis toward and away from the respective fixed carrier arm. The movable carrier arms carry pinions which are engaged with racks on the rotary shaft. The spacings between the fixed and the movable arms are therefore adjustable to the widths of the web rolls to be mounted therebetween, as bidirectional rotation is imparted to the pinions.

This second prior art device possesses the same weakness as the first described one: Each pair of movable and fixed arms are of course not jointly movable for fine repositioning of the web roll. Another disadvantage is that web rolls of different widths can be positioned only against the fixed carrier arms.

Japanese Unexamined Patent Publication No. 7-285709 proposes a more sophisticated web roll positioning system, comprising actuators for simultaneously moving each pair of web roll carrier arms toward and away from each other, synchronizer means for synchronous operation of the arm actuators, and repositioning means for moving the synchronizers axially of the rotary shaft on which the carrier arms are mounted. It also teaches use of truncated-cone-shaped bosses on the distal ends of the carrier arms. With the synchronous travel of each pair of carrier arms toward each other, the bosses are to be inserted in, and frictionally caught by, the opposite ends of the tubular core of the web roll. Thus is the web roll rotatably supported between the carrier arms and, whatever its width may be, positioned centered between the opposite ends of the rotary shaft. Further, by the repositioning means, each pair of carrier arms together with the web roll mounted therebetween are jointly movable in either of the opposite axial directions of the shaft for fine readjustment of the roll position.

This third conventional positioning system is explicitly designed to position web rolls of different widths centrally of the rotary shaft. The repositioning means permit readjustment of the roll position only in the neighborhood of the central position on the shaft. It has therefore been impossible to place a web roll in offset positions on the shaft, that is, against either of the opposite extremities of the shaft.

An additional objection to this known system concerns the conical bosses on each pair of carrier arms which are forced into the opposite ends of the tubular core of the web roll for rotatably supporting the same between the carrier arms. By reaction, then, the bosses exert torsional stresses on the carrier arms, particularly at the proximal ends of the carrier arms where they are slidably mounted on the rotary shaft. The carrier arms so stressed demand inordinately large amounts of torque from the repositioning means for traveling axially of the shaft together with the web roll. Worse yet, the apparatus has suffered immensely in durability.

SUMMARY OF THE INVENTION

The present invention has it as a primary object to defeat all the noted inconveniences and difficulties heretofore encountered in the art and to make possible the quick mounting and highly exact positioning of web rolls.

A more specific object of the invention is to mount a web roll of any of several standard widths in any working position axially of the rotary shaft regardless of the width or position of the previously mounted web roll.

A further object of the invention is to make each pair of carrier arms not only individually movable toward and away from each other but also, together with the web roll supported therebetween, jointly movable all along the rotary shaft.

A further object of the invention is to finely reposition the web roll on the rotary shaft according to possible axial displacement of the web roll relative to the carrier arms.

A further object of the invention is to simplify and integrate the means for individually moving each pair of carrier arms and the means for jointly moving them.

A further object of the invention is to improve the means for rotatably supporting a web roll between each pair of carrier arms, avoiding the exertion of torsional stresses on the carrier arms.

A still further object of the invention is to automate the mounting and positioning of web rolls.

Briefly, the present invention concerns a web supply mechanism in a rotary printing press, wherein a plurality of webs of paper or like printable material in roll form can be held for successive delivery to a printing section by being spliced one to the next. Included are a plurality of, typically two, pairs of carrier arms mounted to a rotary shaft for independent travel axially thereof and constrained to joint rotation therewith, each pair of carrier arms being disposed opposite each other axially of the shaft for holding one web roll therebetween. Each pair of carrier arms have rotatable engagement means for supporting a web roll therebetween so as to permit rotation of the web roll relative to the carrier arms. Also included are independent drive means and joint drive means for the carrier arms. The independent drive means are for independently moving each pair of carrier arms toward and away from each other, at least between "ready" positions, where the pair of carrier arms are spaced from each other a greater distance than the axial dimension of a web roll to be mounted therebetween, and "mount" positions where the web roll is engageable between the pair of carrier arms via the rotatable engagement means. The joint drive means are for jointly moving each pair of carrier arms, normally together with the new web roll mounted therebetween, in either of opposite directions axially of the shaft in order to bring the new web roll to a desired working position from which the web is to be paid off.

Perhaps a most pronounced feature of the invention resides in the fact that each pair of carrier arms are both independently movable toward and away from each other and, together with the web roll mounted therebetween, jointly in either of the opposite axial directions of the rotary shaft. Therefore, rotatably supported between each pair of carrier arms, the web roll may be mounted either centrally of a predetermined track on the rotary shaft, against either end of the track, or in any intermediate position, without interference with the other pair or pairs of carrier arms on the shaft or with the web roll or rolls carried thereby.

The joint drive means are designed in particular to permit fine repositioning of each mounted web roll, which may become necessary because of a failure in correctly placing the web roll centrally between the pair of carrier arms preparatory to engagement by the rotatable engagement means. In that case the web roll may be shifted to the exact working position together with the pair of carrier arms.

Preferably, the independent drive means include internally screw-threaded sleeves rotatably mounted one to each carrier arm and locked against axial displacement relative to the carrier arms. The joint drive means include screw-threaded rods rotatably supported on the shaft, extending parallel to the axis of the shaft, and locked against axial displacement relative to the shaft. Each rod extends through, and is threadedly engaged with, the sleeves on one pair of carrier arms. Thus each pair of carrier arms are independently movable by imparting bidirectional rotation to the threaded sleeves thereon, as from reversible electric motors mounted one to each carrier arm, and jointly movable by imparting bidirectional rotation to the threaded rod, as from an additional reversible electric motor coupled directly to the rod.

It will be appreciated that the independent and the joint drive means coact in part, making use of each other where possible, to perform the functions for which they are intended. The independent and the joint drive means are therefore constituted of a minimal number of parts for reduction of a manufacturing cost. Such means are also designed for positive, trouble-free operation and ease of maintenance for an extended period of time.

Particular attention should be paid to the fact that a single threaded rod needs to be driven in either direction for jointly moving each pair of carrier arms together with the web roll mounted therebetween. Besides being simplified in construction, the joint drive means enable the carrier arms to travel smoothly and with a minimum of positioning errors, making it possible to bring the web roll exactly to the exact working position.

A further feature of the invention resides in a pair of expansion chucks rotatably mounted respectively to each pair of carrier arms for supporting a web roll therebetween so as to permit rotation of the web roll relative to the carrier arms. Each expansion chuck comprises a chuck body capable of insertion in the hollow core of each web roll, and a plurality of struts movable radially of the chuck body into and out of abutment against the inside surface of the hollow core of the web roll. A chuck actuator such as a fluid actuated cylinder may be mounted to each carrier arm for causing the struts of one expansion chuck to move into and out of abutment against the inside surface of the hollow core of the web roll.

Unlike the above cited prior art device in which a pair of cone-shaped bosses on each pair of carrier arms are held fast against the opposite ends of the web roll, the expansion chucks according to the present invention engage the web roll by butting against the interior surface of its tubular core in circumferentially equidistantly spaced positions thereon. The expansion chucks exert no torsional stresses on the carrier arms, contributing to the longer useful life of the carrier arms, the independent and the Joint drive means, and other associated parts.

It is also envisaged within the scope of this invention to automate the complete process of mounting a web roll between each pair of carrier arms and positioning the same in a prescribed working position axially of the rotary shaft. Toward that end the invention suggests the provision of means (e.g. limit switches) for detecting the fact that each carrier arm has been moved to the "ready" position by the independent drive means, means for detecting the fact that each carrier arm has been moved to the "mount" position by the independent drive means, and means (e.g. photoelectric sensors) for sensing distances between each pair of carrier arms and opposite ends of the web roll supported therebetween via the rotatable engagement means.

All such means may be incorporated with an electronic control for automating the apparatus. The distance sensors may be utilized, preferably after each pair of carrier arms have been moved to the "mount" positions together with the web roll, for measuring the axial displacement of the web roll relative to the carrier arms, which displacement has been caused when the web roll is placed between the carrier arms being held in the "ready" positions. Then, according to the measured displacement, the position of the web roll may be readjusted by jointly moving the carrier arm pair together with the web roll. Highly precise, automatic positioning of web rolls will become possible in this manner.

The above and other objects, features and advantages of this invention and the manner of achieving them will become more apparent, and the invention itself will best be understood, from a study of the following description and attached claims, with reference had to the accompanying drawings showing a preferred embodiment of the invention.

DESCRIPTION OF THE PREFERRED EMBODIMENT

General

The present invention will now be described in detail as embodied by way of example in the rotary printing press illustrated in FIG. 1. The exemplified machine is shown to include a printing station 1 having two stacked offset perfecting printing units for printing on both sides of a web of paper or like printable material. The web is supplied from a web supply station 2 where two web rolls are shown rotatably supported at 6*a* and 6*b*. As indicated by the solid line in this figure, the web is now assumed to be paid off from the left hand roll 6*b*, as seen in this figure, threaded over a multiplicity of guide rollers 7, and fed into the printing station 1.

Figure 1:
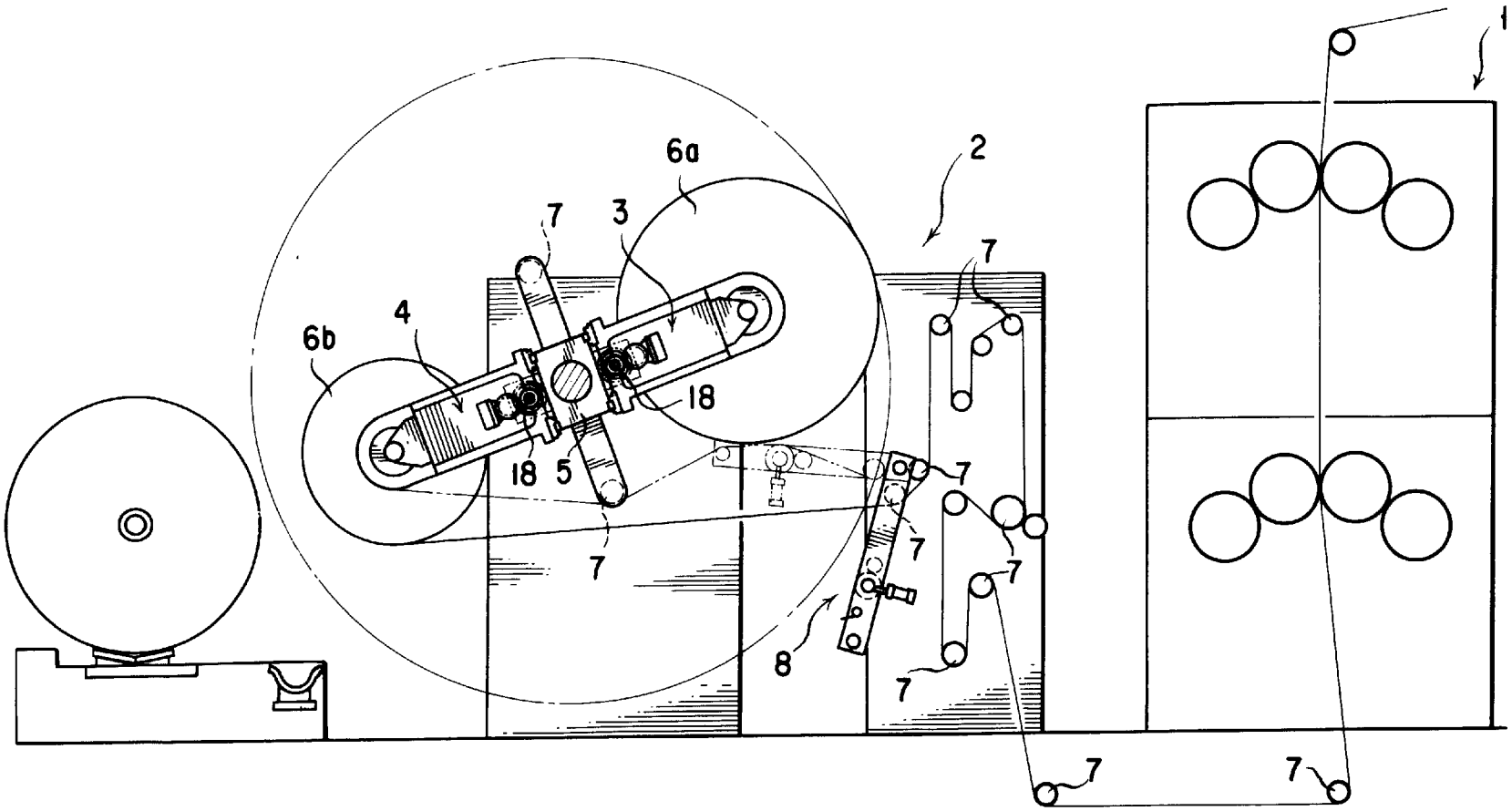
FIG. 1 is a diagrammatic illustration of a web-fed rotary printing press including a web supply mechanism constructed according to the principles of the present invention, the view not showing one of the confronting frame walls of the web supply mechanism.

When the web roll 6*b* is consumed to a prescribed diameter, the web being unwound therefrom is spliced to the other web roll 6*a* by a splicing mechanism 8 of prior art construction, as indicated by the broken lines in FIG. 1. The web is thus supplied continuously from the new roll 6*a* as the same is revolved to the position that has been occupied by the old roll 6*b*.

Figure 2:
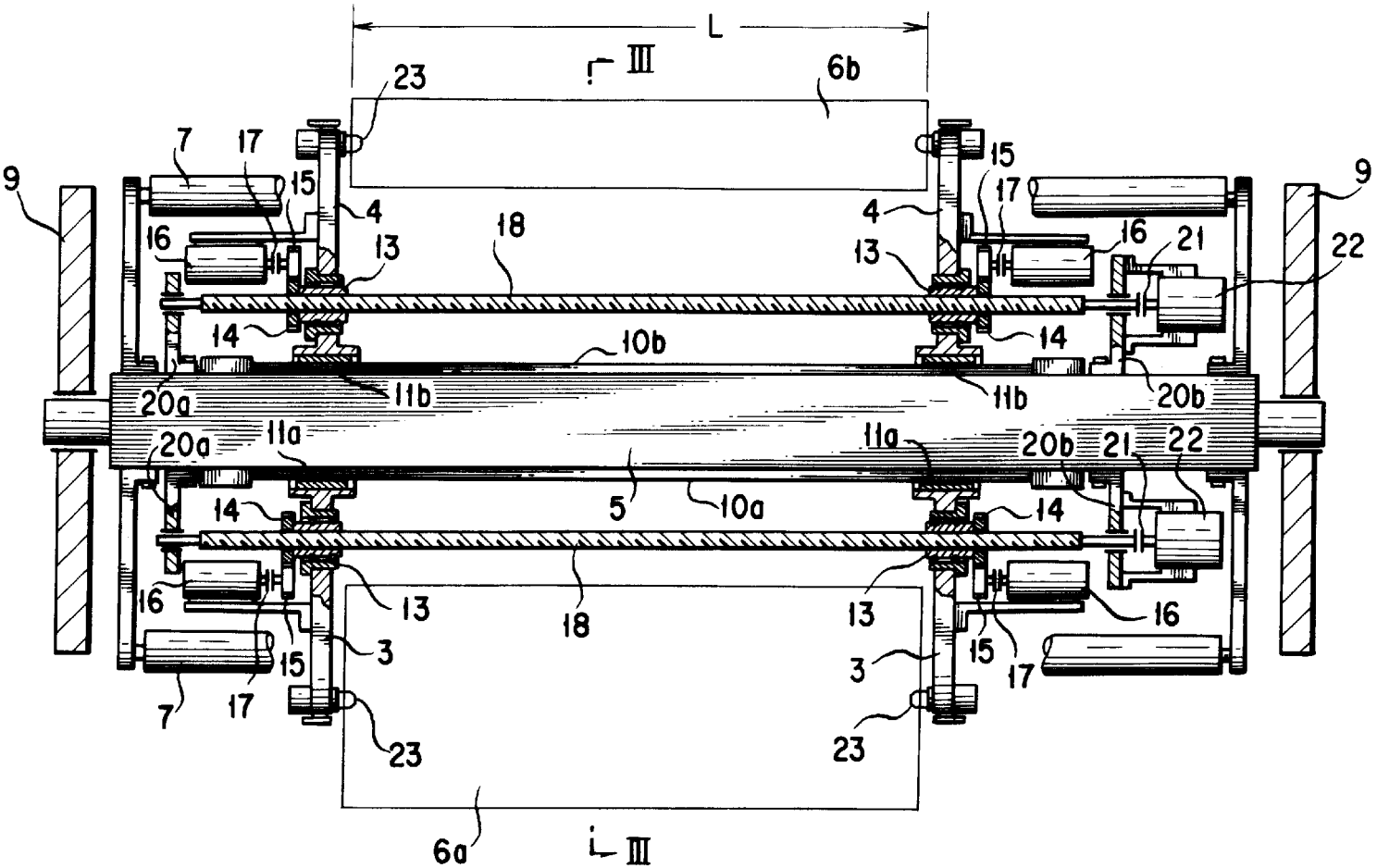
FIG. 2 is an enlarged, transverse axial section, with parts shown broken away to reveal other parts, through the web supply mechanism of the FIG. 1 printing press.
Figure 3:
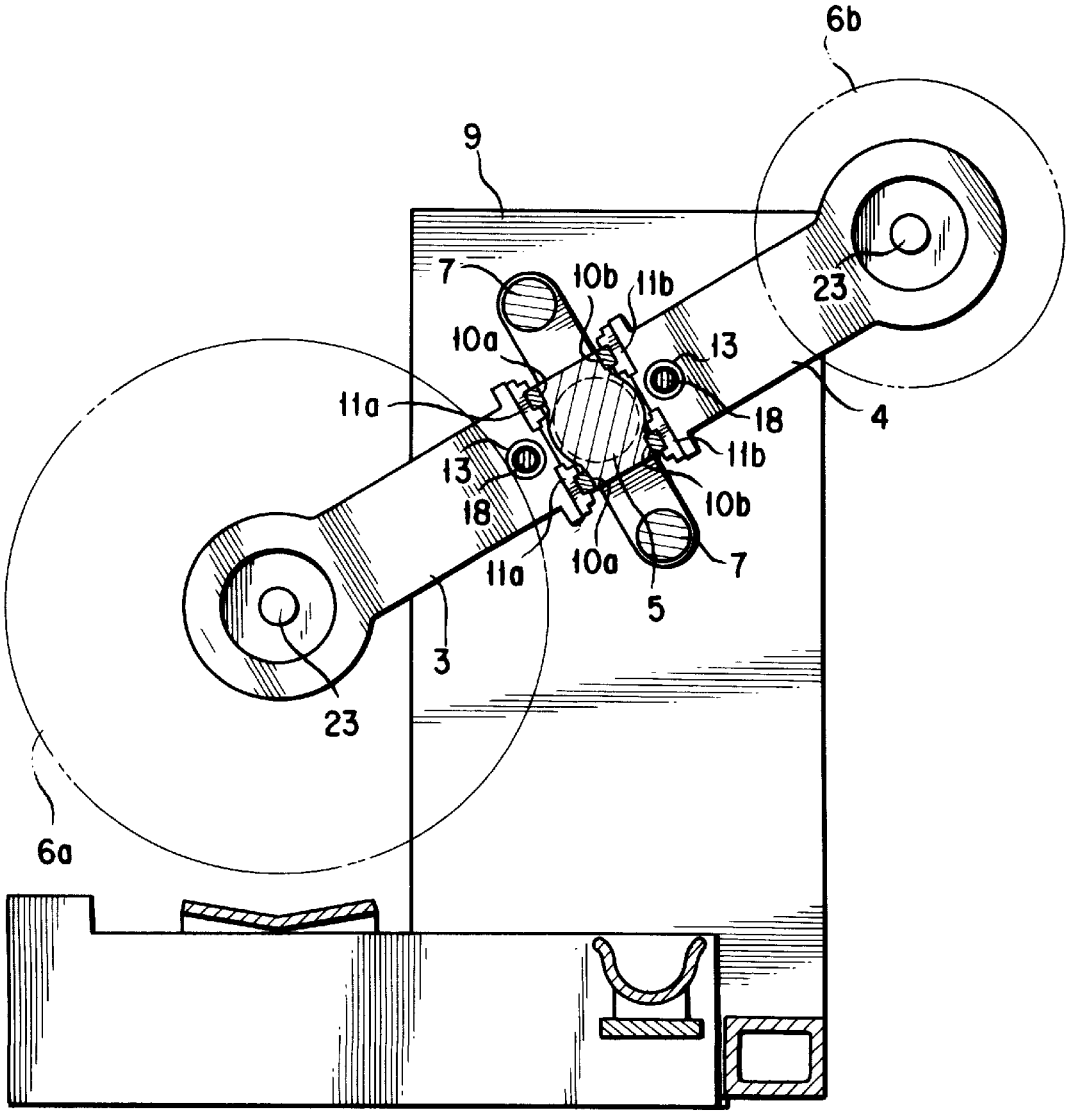
FIG. 3 is a section through the web supply mechanism, taken along the line III—III in FIG. 2.

As drawn also in FIGS. 2 and 3, the web rolls 6*a* and 6*b* are rotatably supported by and between respective pairs of roll carrier arms 3 and 4 of identical make which are mounted radially on a rotary shaft 5. This shaft 5 has its opposite ends journaled in a pair of confronting, upstanding framing walls 9 for rotation about a fixed horizontal axis. The carrier arms 3 and 4 have expansion chucks 23, complete with chuck actuators, built into them adjacent their distal ends for rotatably carrying the web rolls 6*a* and 6*b*, as well as other web rolls of different widths or axial dimensions. One of the expansion chucks and the associated chuck actuator are shown in detail in FIG. 4.

The roll carrier arm pairs 3 and 4 are constrained to joint rotation with the shaft 5 for exchanging the web rolls 6*a* and 6*b* between the two positions depicted in FIGS. 1 and 3. Each carrier arm pair 3 or 4 are, however, free to travel axially of the shaft 5, either jointly, by joint arm drive mechanisms comprising screw-threaded rods 18 and rod drive motors 22, or independently by independent arm drive mechanisms comprising internally screw-threaded sleeves 13 and sleeve drive motors 16. The two carrier arm pairs 3 and 4 are thus enabled to hold different width web rolls and to bring them to required working positions axially of the rotary shaft 5, from which positions the web is to be paid off for delivery to the printing section 1.

The placement of the web rolls in different working positions according to their size can be automated. The present invention teaches electronic Ad control means for such automatic web roll positioning.

Given hereafter are more detailed discussions of the web roll carrier arms, the expansion chucks and chuck actuators, the joint arm drive mechanisms, the independent arm drive mechanisms, and the electronic control, in that order and under separate headings. Operational description will follow the discussions of the listed means.

Web Roll Carrier Arms

The two pairs of web roll carrier arms 3 and 4 are intended as aforesaid to travel axially of the shaft 5, both jointly and independently, but to revolve with this shaft. For accomplishment of these purposes, as will be understood from FIGS. 2 and 3, all but the opposite end journals of the shaft 5 is made square in cross sectional shape, and two pairs of guide rails 10*a* and 10*b* are laid on the opposite sides of the shaft so as to extend parallel to its axis.

Slidably engaged with these guide rails 10*a* and 10*b* are four pairs of shoes 11*a* and 11*b*, each shoe pair 11*a* being affixed to the proximal end of one carrier arm 3, and each shoe pair 11*b* to the proximal end of one carrier arm 4. Thus the carrier arms 3 and 4 are slidable axially of the shaft 5 but constrained to joint rotation therewith.

Expansion Chucks and Chuck Actuators

FIG. 2 best reveals that all the carrier arms 3 and 4 have expansion chucks 23 mounted to their distal ends together with the chuck actuators. The two expansion chucks on each pair of carrier arms 3 or 4 are aligned parallel to the axis of the shaft 5 for rotatably holding one web roll 6*a* or 6*b* therebetween. Since the four expansion chucks and four chuck actuators used in this embodiment are all alike in construction, only one of the chucks together with one associated chuck actuator will be described in detail with reference to FIGS. 4 and 5, it being understood that the same description applies to all the other chucks and chuck actuators.

Figure 4:
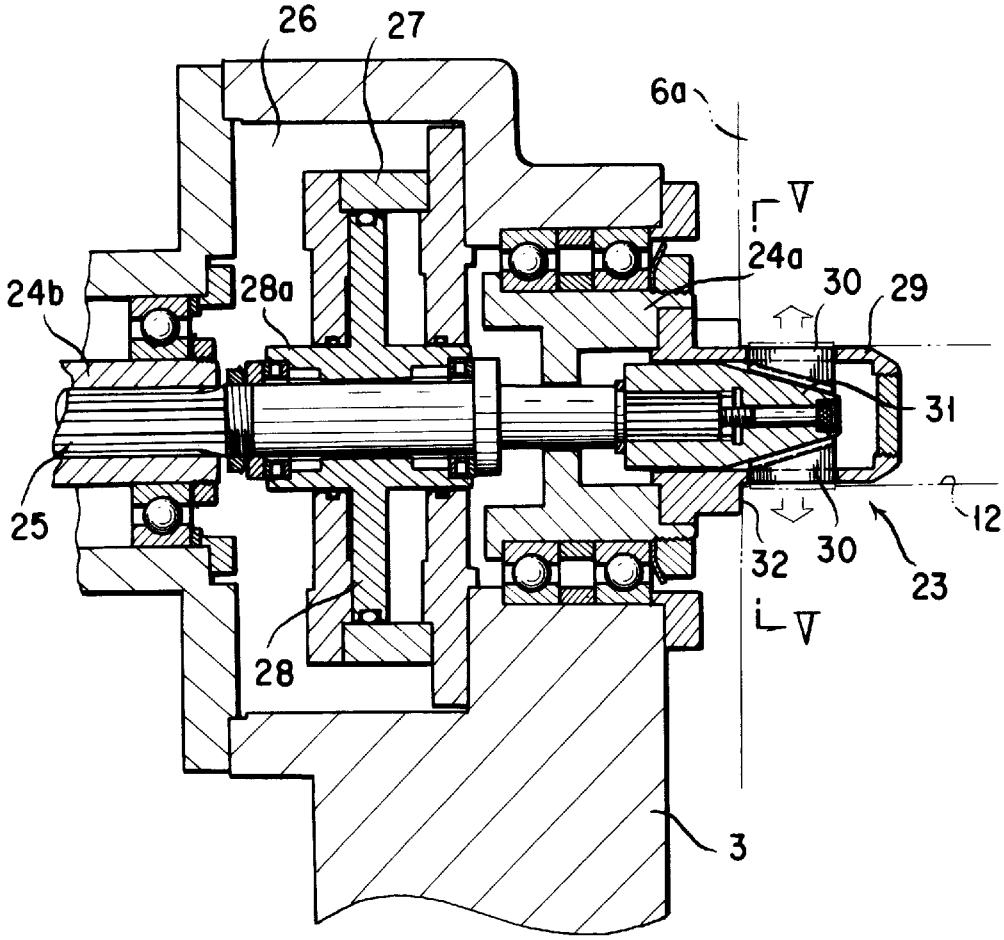
FIG. 4 is an enlarged, fragmentary axial section through one of the expansion chucks of the FIG. 2 web supply mechanism, the representative expansion chuck being shown together with one of the chuck actuators provided one for each expansion chuck.
Figure 5:
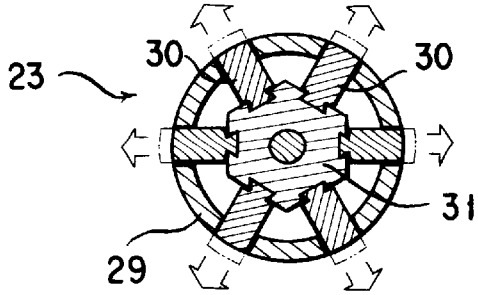
FIG. 5 is a section through one of the expansion chucks, taken along the line V—V in FIG. 4.

Depicted on a greatly enlarged scale in FIG. 4, the representative expansion chuck 23 is here assumed to be the one on the left hand one, as seen in FIG. 2, of the pair of carrier arm 3 holding the web roll 6*a*. The expansion chuck 23 comprises a chuck body of tubular shape, closed at one end and open at the other, having a plurality of, six in the illustrated embodiment, radial slots cut therein, and as many struts 30 slidably engaged one in each slot in the chuck body. As indicated by the arrows in FIG. 5, the struts 30 are movable relative to the chuck body 29 out of and back into the radial slots therein.

As drawn in phantom outline in FIG. 4, the web roll 6*a*, as well as any web rolls for use with this apparatus, is presupposed to possess a hollow core 12 of known diameter only slightly more than that of the chuck body 29. The expansion chuck 23 is to be inserted in this hollow core 12 with its struts 30 contracted. Upon subsequent expansion the struts 30 are to butt against the interior surface of the hollow core 12 thereby firmly engaging the web roll at one end thereof. The expansion chuck 23 is rotatable relative to the carrier arm 3 with the web roll 6*a* and parts of the chuck actuator yet to be described.

At 32 in FIG. 4 is seen a rimbase formed concentrically around the chuck body 29 adjacent to the proximal end thereof, which is to be held opposite one end of the web roll upon insertion of the expansion chuck in its hollow core 12. This rimbase 32 will be later referred to in the course of the description of how web rolls are positioned axially of the shaft 5.

In order to cause the expansion and contraction of the chuck 23 there is provided the chuck actuator best shown also in FIG. 4. The chuck actuator is, in short, a double-acting, double-ended-rod air cylinder 27 immovably mounted in a hollow 26 in the carrier arm 3. The cylinder 27 has a piston 28 slidably and pressure-tightly mounted therein to define a pair of opposed air chambers. The piston 28 is shown as being of one-piece construction with a hollow, double-ended piston rod 28*a* projecting in opposite directions from the cylinder 27. Extending coaxially through the piston rod 28*a* is a drive spindle 25 which is rotatable relative to the piston rod but locked against axial displacement relative to the same. The drive spindle 25 is further slidable axially through, but constrained to joint rotation with, two spaced sleeves 24*a* and 24*b* which are both rotatably supported by the carrier arm 3 via bearings. The chuck body 29 is press-fitted in the sleeve 24*a* for joint rotation therewith.

Coaxially mounted fast on one end of the drive spindle 25, a cone-shaped cam 31 extends into the expansion chuck body 29 for driving engagement with the radial struts 30. As better illustrated in FIG. 5, the cam 31 has undercut grooves formed therein for slidably receiving dovetail-shaped ridges on the base ends of the struts 30.

Thus the drive spindle 25 will travel back and forth as air under pressure is supplied alternately into the air chambers of the cylinder 27 from a source, not shown, of such pressurized air via suitable piping and valving. The struts 30 of the expansion chuck 23 will expand and contract with such linear reciprocation of the drive spindle 25, into and out of chucking engagement with the hollow core 12 of the web roll. As the web roll rotates, so will the expansion chuck 23, when the same is in chucking engagement with the web roll, together with the cam 31, the drive spindle 25, and the sleeves 24*a* and 24*b*.

Joint Arm Drive Mechanisms

The joint arm drive mechanisms and the independent arm drive mechanisms are cooperative and not strictly divisible because either does not function without the other. They will nevertheless be described separately for convenience of disclosure.

With reference to FIG. 2 in particular, two screw-threaded rods 18 are shown rotatably supported by and between respective pairs of lugs 20*a* and 20*b* on the shaft 5 in conformity with the two pairs of web roll carrier arms 3 and 4 employed in this particular embodiment. Each threaded rod 18 extends parallel to the axis of the shaft 5 and is locked against axial displacement relative to that shaft. A reversible electric drive motor 22 is mounted on the shaft 5 and drivingly coupled to each threaded rod 18 via a torque limiter 21. The two motors 22 of the joint arm drive mechanisms will be hereinafter referred to as the joint drive motors.

Independent Arm Drive Mechanisms

FIG. 2 further indicates that internally screw-threaded sleeves 13 are received respectively in aligned holes in each pair of web roll carrier arms 3 or 4. Each threaded rod 18 of the joint arm drive mechanisms extends through, and is threadedly engaged with, the threaded sleeves 13 in one pair of carrier arms 3 or 4. The internally threaded sleeves 13 are rotatable relative to the carrier arms 3 and 4 but locked against axial displacement relative to the same.

Each threaded sleeve 13 is formed in one piece with a driven gear 14 loosely surrounding one threaded rod 18. Each driven gear 14 is in mesh with a drive gear 15 which is coupled to the armature shaft of a reversible electric motor 16 via a torque limiter 17. A total of four such motors 16 are thus provided and mounted one to each carrier arm 3 or 4 for independently driving the four carrier arms. These motors 16 will be hereinafter referred to as the independent drive motors in contradistinction from the noted joint drive motors 22.

Thus, with the bidirectional rotation of either of the joint drive motors 22, one pair of carrier arms 3 and 4 will travel jointly in either direction along the axis of the shaft 5. All the carrier arms are further independently movable in either direction along the shaft axis with the bidirectional rotation of the independent drive motors 16.

Electronic Control

Figure 6:
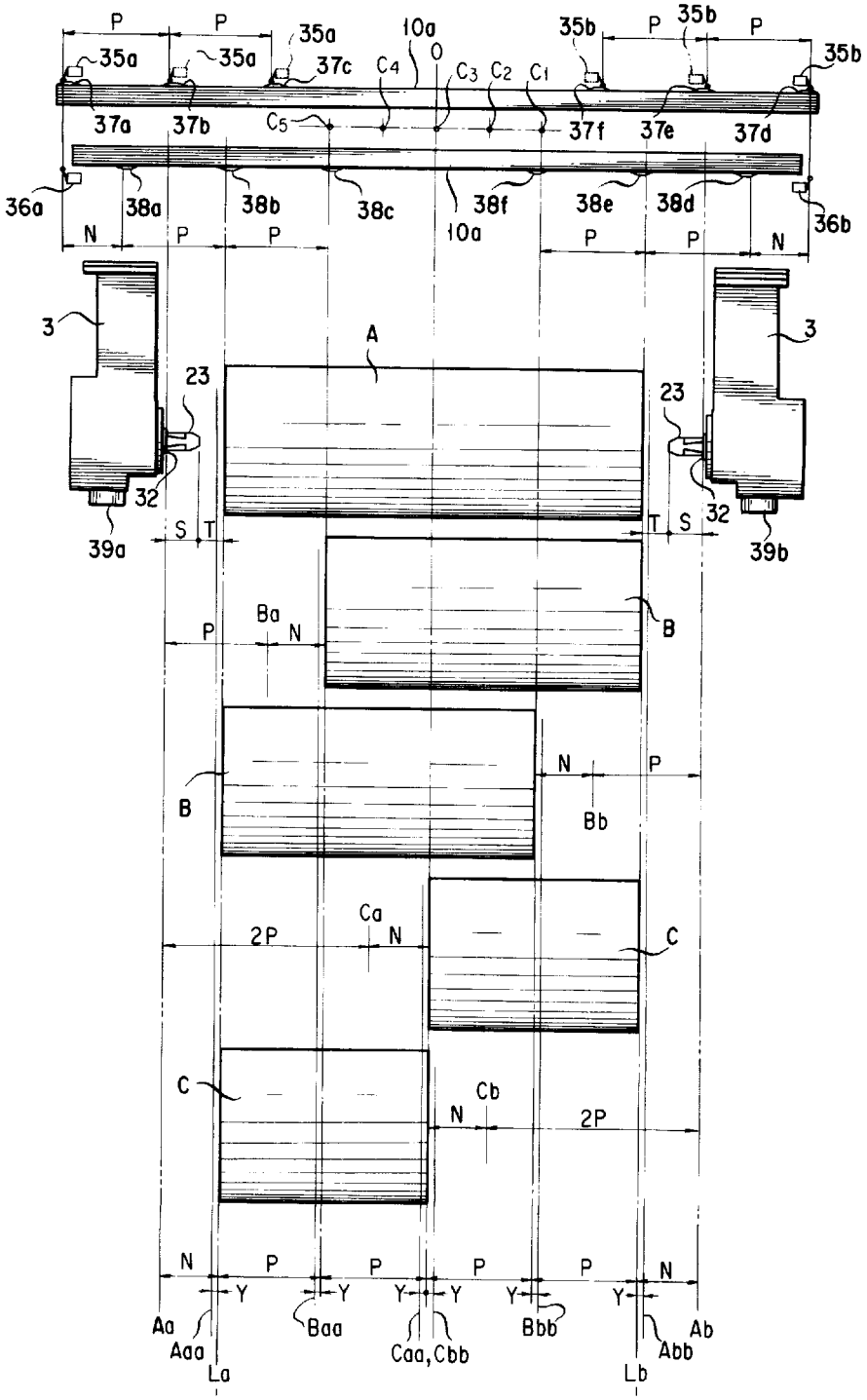
FIG. 6 is a diagram explanatory of how web rolls of different axial dimensions are mounted between each pair of carrier arms and positioned for web delivery.

Before setting forth the electric control means used in the illustrated embodiment for automatic positioning of web rolls, there must first be studied the web rolls of particular widths to be handled and the working positions to be occupied thereby. Web rolls A, B and C of three different standard widths are shown in FIG. 6, in which the capital P represents the width of one newspaper page. The web roll A has the width 4P, which means the total width of four newspaper pages; the web roll B the width 3P; and the web roll C the width 2P. The widest web roll A is shown in its only possible working position with respect to the guide rail pair 10*a*, that is, shown centered with its axial midpoint in register with the longitudinal midpoint of the guide rail pair. Let La and Lb be the pair of extreme roll end positions on the guide rail pair 10*a*, to be occupied by the opposite ends of the widest web roll A when it is held between the pair of carrier arms 3 and thereby centered. The working positions of the medium width web roll B and the narrowest web roll C may be such that either their left hand ends, as viewed in FIG. 6, are in the left hand extreme roll end position La, or their right hand ends in the right hand extreme roll end position Lb. In addition to these offset working positions, the undersize web rolls B and C may also have central working positions like the web roll A, with their opposite ends both spaced inwardly from the extreme roll end positions La and Lb.

In FIG. 6 the pair of carrier arms 3 are shown in READY positions with respect to the widest web roll A; that is, they are in positions ready for accepting a new widest web roll therebetween preparatory to chucking, as the roll is transported, as by an unmanned vehicle, from a place of storage. These READY positions, indicated Aa and Ab in FIG. 6, are such that the rimbases 32 of the expansion chucks 23 are spaced from the extreme roll end positions La and Lb by distances N which are each equal to the length S of each expansion chuck plus the clearance T between the tip of the chuck and the opposite end of the web roll. The clearances T are those needed for permitting the widest web roll to be placed between the pair of carrier arms 3 without interference with the expansion chucks 23. The READY positions may therefore be restated as those where the clearances T exist between the tips of the expansion chucks 23 and the opposite ends of the web roll A.

A continued study of FIG. 6 will further indicate that the READY positions of the carrier arms 3 are at Ba and Ab when the medium width web roll B is to be positioned with one end thereof in the right hand extreme roll end position Lb; at Aa and Bb when the medium width web roll B is to be positioned with one end thereof in the left hand extreme roll end position La; at Ca and Ab when the narrowest web roll C is to be positioned with one end thereof in the right hand extreme roll end position Lb; and at Aa and Cb when the narrowest web roll C is to be positioned with one end thereof in the left hand extreme roll end position.

From the READY positions Aa and Ab, for example, the pair of carrier arms 3 are to be moved toward each other to MOUNT positions Aaa and Abb, where the expansion chucks 23 are inserted in the hollow core of the widest web roll A to required degrees, for chucking the roll. In these MOUNT positions the expansion chuck rimbases 32 are each spaced a predetermined minimal distance Y from one end of the web roll, so that the distances from READY to MOUNT positions are each N (=S+T) minus Y.

Similarly, the carrier arms 3 may be moved to MOUNT positions Baa and Abb for chucking the medium width web roll B with one end thereof in the right hand extreme roll end position Lb; to MOUNT positions Aaa and Bbb for chucking the medium width web roll B with one end thereof in the left hand extreme roll end position La; to MOUNT positions Caa and Abb for chucking the narrowest web roll C with one end thereof in the right hand extreme roll end position Lb; and to MOUNT positions Aaa and Cbb for chucking the narrowest web roll C with one end thereof in the left hand extreme roll end position La. All the additional MOUNT positions Baa, Bbb, Caa and Cbb set forth in this paragraph are spaced the same distance (N−Y) from the READY positions Ba, Bb, Ca and Cb, respectively.

Now, for automatic control of web roll positioning, there are provided two limit switches 35*a* and 36*a* which, unlike the showing of FIG. 6, are mounted to one of the pair of carrier arm 3 (as well as to one of the other pair of carrier arms 4), and two other limit switches 35*b* and 36*b* mounted to the other of the carrier arm pair 3 (as well as to the other of the other carrier arm pair 4).

As shown also in FIG. 6, one of the pair of guide rails 10*a* (as well as one of the other pair of guide rails 10*b*) has formed thereon a series of abutments 37*a*, 37*b* and 37*c* and another similar series of abutments 37*d*, 37*e* and 37*f*. The two series of abutments are to be hit by the actuating arms of the limit switches 35*a* and 35*b*, respectively, on both carrier arms 3 when these carrier arms come respectively to the READY positions Aa, Ba and Ca and to the READY positions Ab, Bb and Cb.

On the other of the pair of guide rails 10*a* (as well as the other of the other pair of guide rails 10*b*) there are formed a series of abutments 38*a*, 38*b* and 38*c* and another similar series of abutments 38*d*, 38*e* and 38*f* to be abutted upon by the actuating arms of the limit switches 36*a* and 36*b*, respectively, on both arms 3 when these arms come respectively to the MOUNT positions Aaa, Baa and Caa and to the MOUNT positions Abb, Bbb and Cbb.

The travel of the roll carrier arms 3 or 4 to the READY and the MOUNT positions may be detected by means other than the limit switches set forth above. Alternatively, for example, there may be employed pulse generators which put out pulses in proportion with the revolutions of the internally threaded nuts 13, FIG. 2, on all the carrier arms 3 and 4. Since the distance traversed by each carrier arm per unit-angle rotation of the nut 13 can be known, the travel of the carrier arms to any of the READY and the MOUNT positions from a reference can be ascertained by counting the pulses.

As an additional alternative, pulse generators and limit switches may be put to combined use. For example, pulse generators may be used for detecting the travel of the carrier arms to only the READY positions, and limit switches for detecting the travel of the carrier arms to only the MOUNT positions, or vice versa.

At 39*a* and 39*b* in FIG. 6 are shown distance sensors mounted one on each carrier arm 3 (as well as on each carrier arm 4) for measuring the distances between the carrier arms and the opposite ends of the web roll chucked therebetween. These distance sensors are displacement sensors of known construction comprising a laser and a photodetector and measuring distances by triangulation. Converged by a lens, the laser beam irradiates one end of the web roll, and a particular angle component of the divergently reflected light falls as a spot on the photodetector. The location of the beam spot on the photodetector differs with the distance between the sensor and the web roll end, and the output voltage of the photodetector varies approximately linearly with the beam spot location. The distance between sensor and web roll is therefore obtainable by processing the photodetector output voltage.

How to Mount Web Rolls

With reference to FIG. 2, for mounting a web roll 6*a* of width L, for example, between one pair of carrier arms 3, these arms may first be moved to READY positions where the spacing between the tips of the expansion chucks 23 thereon is equal to the web roll width L plus 2 T, FIG. 6. Then, with the web roll 6*a* held between the pair of carrier arms 3, these arms may be moved toward each other from the READY to the MOUNT positions where the expansion chucks 23 are inserted to the required degree in the hollow core 12, FIG. 4, in the web roll.

Then the air cylinders 27 built into the carrier arms 3 may be both extended thereby causing the cams 31 on the drive spindles 25, which are coaxially coupled to the piston rods of the air cylinders, to move the expansion chuck struts 30 radially outwardly of the chuck bodies 29. So expanded, the chuck struts 30 will come into abutment against the interior surface of the web roll core 12. The web roll has now been chucked between the pair of carrier arms 3, ready to rotate with the expansion chucks 23 and the chuck actuator spindles 25 relative to the carrier arms 3.

Prior to commencement of web delivery from the chucked roll, however, the web roll may have to be repositioned axially of the shaft 5. The web roll is readily movable with the pair of carrier arms 3 in either direction along the shaft 5 as the carrier arms slide along the pair of guide rails 10*a* thereon with the rotation of the joint drive motor 22 in the required direction.

Described hereinbelow is how the widest web roll A is automatically mounted between the pair of carrier arms 3 and positioned centrally on the pair of guide rails 10*a*. The operator may specify on input equipment, not shown, the size of the web roll A as well as the carrier arm pair 3 to which it is to be mounted. Since the web roll is now assumed to be the widest, the electronic control connected to the input equipment will receive instructions to bring the pair of carrier arms 3 to the READY positions Aa and Ab for the widest web roll.

Thus, under the direction of the electronic control, the internally threaded nuts 13 on the carrier arm pair 3 will be driven by the respective independent drive motors 16 in such a direction as to cause the carrier arms to travel away from each other, until, traveling past the READY positions Aa and Ab, they are initialized in prescribed starting positions. Then the independent drive motors 16 will be reversed, causing the carrier arms 3 to travel toward each other. The limit switches 35*a* and 35*b* on the carrier arms 3 will hit the abutments 37*a* and 37*d*, respectively, when the carrier arms come to the READY positions Aa and Ab, thereby setting the independent drive motors 16 out of rotation. This state is pictured in FIG. 6.

It is assumed that the new web roll A to be mounted between the carrier arms 3 has been carried as by an unmanned, trackless vehicle, not shown, from the place of web roll storage. It is further understood that the vehicle is equipped with a lift for elevating and holding the new web between the carrier arms 3, which have been brought to the READY positions as above, and approximately in axial alignment with the expansion chucks 23 on both carrier arms.

Then the independent drive motors 16 will be set in rotation again for causing the carrier arms 3 to travel the preassigned distance (N−Y) toward each other, with the consequent insertion of the expansion chucks 23 in the hollow core 12 of the web roll. The limit switches 36*a* and 36*b* on the carrier arms 3 will engage the abutments 38*a* and 38*d*, respectively, thereby setting the independent drive motors 16 out of rotation, when the carrier arms come to the MOUNT positions Aaa and Abb. In these MOUNT positions the expansion chuck rimbases 32 are spaced as aforesaid the predetermined minimal distance Y from the opposite ends of the web roll.

Possibly, the unmanned vehicle may have positioned the new web roll A displaced in either axial direction thereof between the carrier arms 3 when these arms were in the READY positions Aa and Ab. The displacement may have been so great, indeed, that the expansion chuck rimbase 32 on either of the carrier arms 3, both traveling toward the MOUNT positions Aaa and Abb, may come into abutment against one end of the web roll well before traversing the required distance (N−Y). Then the independent drive motor 16 driving the carrier arm 3 in question will be overloaded, whereupon the torque limiter 17 will operate to disconnect, as far as power transmission is concerned, this motor from the associated carrier arm, causing the motor to rotate unloaded. The motor will, however, be automatically stopped immediately thereafter as a sensor, not shown, senses the motor racing and signals the electronic control accordingly.

Inputting the sensor output, the control electronics will visibly indicate the abnormal web roll supply and cause a retry of web roll supply. The retry may be made, for example, by another unmanned vehicle carrying another web roll.

Let us return to the normal case in which both independent drive motors 16 stop after both carrier arms 3 have traveled approximately the same distance (N−Y) from READY positions Aa and Ab to MOUNT positions Aaa and Abb. Then air under pressure will be supplied into the chuck actuating cylinders 27, FIG. 4, causing their pistons 28 to travel forwardly, to the right as viewed in this figure, on their chucking stroke. As the pistons 28 travel forwardly, so will the drive spindles 25 and the cams 31. The forward travel of the cams 31 will result in the expansion of the radial struts 30 of the expansion chucks 23, into chucking engagement with the hollow core 12 of the new web roll, designated 6*a* in FIG. 4.

Now the new web roll has been firmly and rotatably mounted between the pair of carrier arms 3. It is understood that the electronic control is equipped to know the chucking of the web roll, for causing the descent of the lift on the vehicle upon completion of the web roll chucking.

The pair of carrier arms 3 are now in the MOUNT positions Aaa and Abb as aforesaid, with the limit switches 36*a* and 36*b* on the carrier arms in engagement with the abutments 38*a* and 38*d*, respectively. The new web roll will therefore be in the proper working position for the widest web roll, with its opposite ends in the extreme roll end positions La and Lb, if it was positioned exactly midway between the pair of carrier arms 3 when they were in the READY positions Aa and Ab.

This will not always be the case, however. The new web roll may have been loaded somewhat out of position on the vehicle, or the vehicle may have somewhat deviated from the desired course during its guided run. The web roll may not be in the correct working position in such cases, even though the carrier arms are themselves in the correct MOUNT positions.

Figure 7:
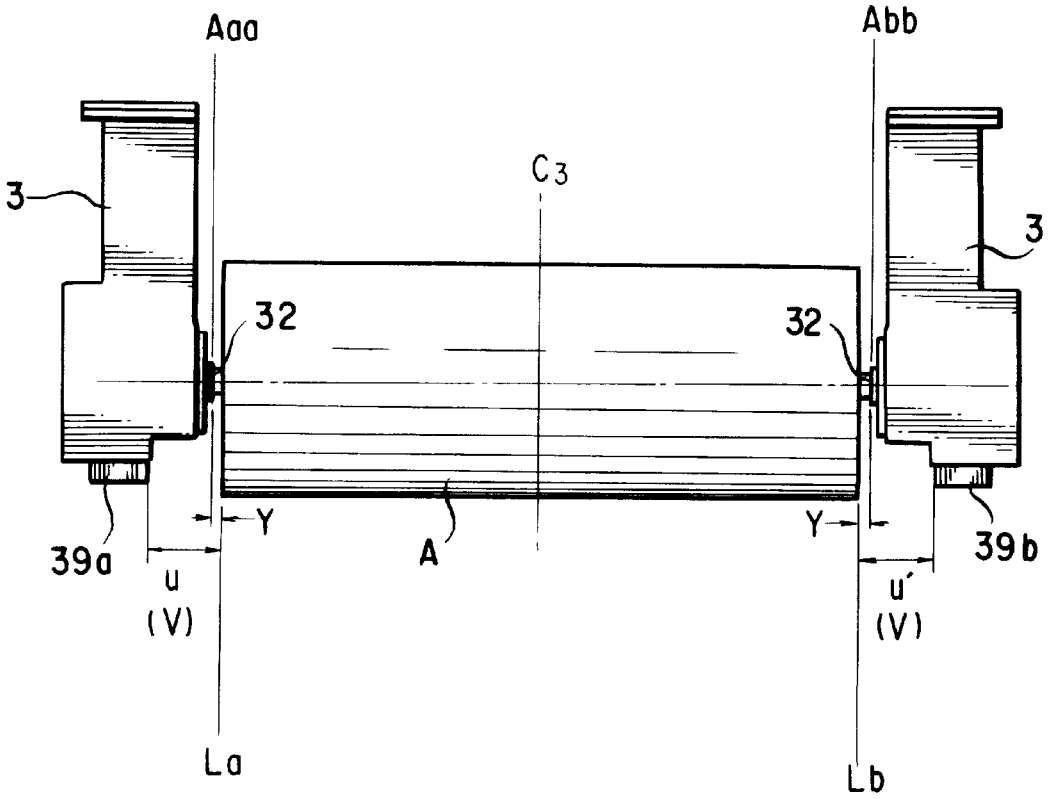
FIG. 7 is a view somewhat similar to FIG. 6 but explanatory of how a web roll is positioned centrally between the opposite extremities of a guide track for each pair of carrier arms.

In order to reposition the web roll in such cases, there are provided the noted distance sensors 39*a* and 39*b* on both carrier arms, as shown in both FIGS. 6 and 7. Upon lapse of a predefined length of time, as measured by counting clock pulses, from the completion of the web roll chucking, the voltage output from the distance sensor 39*a*, for example, may be utilized by the electronic control thereby to determine the distance U, FIG. 7, from that sensor to one end of the web roll. This measured actual distance U may then be compared with the distance V that should exist therebetween if the web roll lies in the exact working position. Then it may be judged whether the difference between the actual and the desired distances is within a prescribed range of allowable displacement.

If the difference is greater than the allowable range, that is, if the web roll is displaced too much in either direction from the correct working position, then the joint drive motor 22 may be operated to rotate the threaded rod 18 and hence to drive both carrier arms 3 jointly in the required direction, until the ends of the web roll come to the correct roll end positions La and Lb. The distance thus traversed by the carrier arms 3 should be half the difference between the actual and the desired distances . The direction of rotation of the motor 22 depends upon whether the actual distance U is greater or less than the correct distance V. The rotation of the motor 22 that is required to cause the carrier arm travel over the required distance may be controlled by the electronic control.

Only one distance sensor has been needed in the above described case. In some cases, however, the need may arise for repositioning the web rolls A, B and C, FIG. 6, of various widths with respect to the midpoints $C_1$, $C_2$, $C_3$, $C_4$ and $C_5$ of their working positions. For instance, the widest web roll A should have its axial midpoint at $C_3$ when positioned with its opposite ends in the extreme roll end positions La and Lb. The medium width web roll B should have its axial midpoint at $C_2$ when positioned with its right hand end in the right hand extreme roll end position Lb. The narrowest web roll C should have its axial midpoint at $C_1$ when positioned with its right hand end in the right hand extreme roll end position Lb, and so forth.

In such cases, as indicated in FIG. 7, the distances U and U' may both be measured from the distance sensors 39*a* and 39*b* on both carrier arms 3 to the opposite ends of the web roll, herein designated A, supported therebetween. The possible displacement X of the axial midpoint of the web roll A from the midpoint, $C_3$ in this case, of the correct working position for the widest web roll may be computed by the equation $$X=(U+U')/2-U$$

or $$X=(U+U')/2-U'.$$

If, for instance, U is five, and U' seven, the unit being omitted, then $$K=(5+7)/2-5=1$$

or $$X=(5+7)/2-7=-1.$$

Thus the displacement has proved to be +1 or −1 (whatever the unit may be), the plus and minus signs being indicative of the direction of the displacement. It may then be determined if the amount of displacement thus computed is within the prescribed range of tolerances. If it is not, the joint drive motor 22 may be energized to cause joint travel of the carrier arm pair 3, together with the web roll mounted thereto, in the direction of the greater one of the measured distances U and U' by the computed displacement X. The web roll will then come to the correct working position, with the midpoint of the web roll in exact register with the midpoint $C_3$ of the working position. The rotational direction of the joint drive motor 22 in this case depends upon which of the foregoing two equations was used for computation of the displacement X, and whether this displacement is positive or negative.

In either case of positional readjustment of the web roll by the joint drive motor 22, the amount of rotation of the threaded rod 18 may be constantly monitored, as in terms of pulses produced in step with its rotation. The rotation of the joint drive motor 22 may be controlled by the control electronics accordingly.

Although the foregoing operational description has been limited to the central positioning of the widest web roll, it will be self-evident that the narrower web rolls can likewise be mounted in either the central or the offset positions or in any positions in between.

Despite the foregoing detailed disclosure, it is not desired that the present invention be limited by the exact showing of the drawings or the description thereof. A variety of modifications or alterations of the illustrated embodiment will suggest themselves to one skilled in the art to conform to design preferences or to the requirements of each specific application of the invention to a particular printing press, without departing from the scope of the claims attached hereto.

What is claimed is:

1. In a web supply mechanism in a rotary printing press, wherein a plurality of webs of paper or like printable material in roll form can be held for successive delivery to a printing section by being spliced one to the next, in combination:

frame means;

a shaft mounted to the frame means for rotation about a fixed axis thereof;

a plurality of pairs of opposing carrier arms mounted to the shaft, respective ones of each pair of opposing carrier arms being mounted for independent travel axially relative to each other and constrained to joint rotation with the shaft, each pair of carrier arms being disposed opposite each other axially of the shaft for holding one web roll therebetween;

rotatable engagement means mounted to each pair of carrier arms for supporting a web roll therebetween so as to permit rotation of the web roll relative to the carrier arms;

independent drive means for independently moving each pair of carrier arms toward and away from each other, at least between "ready" positions, where the pair of carrier arms are spaced from each other a greater distance than the axial dimension of a web roll to be mounted therebetween, and "mount" positions where the web roll is mountable between the pair of carrier arms via the rotatable engagement means; and joint drive means separate from the independent drive means for jointly moving each pair of carrier arms in either of opposite directions axially of the shaft in order to bring the new web roll to a desired working position from which the web is to be paid off.

2. The invention of claim 1 further comprising means for sensing a distance between at least either of each pair of carrier arms and one end of the web roll supported therebetween via the rotatable engagement means.

3. In a web supply mechanism in a rotary printing press, wherein a plurality of webs of paper or like printable material in roll form can be held for successive delivery to a printing section by being spliced one to the next, in combination:

frame means;

a shaft mounted to the frame means for rotation about a fixed axis thereof;

a plurality of pairs of carrier arms mounted to the shaft for independent travel axially thereof and constrained to joint rotation therewith, each pair of carrier arms being disposed opposite each other axially of the shaft for holding one web roll therebetween;

rotatable engagement means mounted to each pair of carrier arms for supporting a web roll therebetween so as to permit rotation of the web roll relative to the carrier arms;

independent drive means for independently moving each pair of carrier arms toward and away from each other, at least between "ready" positions, where the pair of carrier arms are spaced from each other a greater distance than the axial dimension of a web roll to be mounted therebetween, and "mount" positions where the web roll is mountable between the pair of carrier arms via the rotatable engagement means;

joint drive means for jointly moving each pair of carrier arms in either of opposite directions axially of the shaft in order to bring the new web roll to a desired working position from which the web is to be paid off;

means for detecting that each carrier arm has been moved to the "ready" position by the independent drive means; and means for detecting that each carrier arm has been moved to the "mount" position by the independent drive means.

4. In a web supply mechanism in a rotary printing press, wherein a plurality of webs of paper or like printable material in roll form can be held for successive delivery to a printing section by being spliced one to the next, in combination:

frame means;

a shaft mounted to the frame means for rotation about a fixed axis thereof;

a plurality of pairs of opposing carrier arms mounted to the shaft for independent travel axially thereof and constrained to joint rotation therewith, each pair of carrier arms being disposed opposite each other axially of the shaft for holding one web roll therebetween;

rotatable engagement means mounted to each pair of carrier arms for supporting a web roll therebetween so as to permit rotation of the web roll relative to the carrier arms;

independent drive means for independently moving each pair of carrier arms toward and away from each other, at least between "ready" positions, where the pair of carrier arms are spaced from each other a greater distance than the axial dimension of a web roll to be mounted therebetween, and "mount" positions where the web roll is mountable between the pair of carrier arms via the rotatable engagement means;

joint drive means for jointly moving each pair of carrier arms in either of opposite directions axially of the shaft in order to bring the new web roll to a desired working position from which the web is to be paid off;

means for detecting that each carrier arm has been moved to the "ready" position by the independent drive means;

means for detecting that each carrier arm has been moved to the "mount" position by the independent drive means;

means for sensing distances between each pair of carrier arms and opposite ends of the web roll supported therebetween via the rotatable engagement means;

whereby the independent drive means and the joint drive means are controllable for automatically positioning the web roll in a required working position.

5. In a web supply mechanism in a rotary printing press, wherein a plurality of webs of paper or like printable material in roll form can be held for successive delivery to a printing section by being spliced one to the next, in combination:

(a) frame means;

(b) a shaft mounted to the frame means for rotation about a fixed axis;

(c) a plurality of pairs of carrier arms mounted to the shaft for independent travel axially thereof and constrained to joint rotation therewith, each pair of carrier arms being disposed opposite each other axially of the shaft for holding one web roll therebetween;

(d) rotatable engagement means mounted to each pair of carrier arms for supporting a web roll therebetween so as to permit rotation of the web roll relative to the carrier arms;

(e) a plurality of internally screw-threaded sleeves rotatably mounted one to each carrier arm and locked against axial displacement relative to the carrier arms;

(f) a plurality of screw-threaded rods rotatably supported on the shaft, extending parallel to the axis of the shaft, and locked against axial displacement relative to the shaft, each rod extending through, and threadedly engaged with, the sleeves on one pair of carrier arms;

(g) independent drive means for imparting bidirectional rotation to each threaded sleeve; and (h) joint drive means for imparting bidirectional rotation to each threaded rod;

(i) whereby each pair of carrier arms is reciprocable axially of the shaft both independently and jointly.

6. The invention of claim 5 wherein the independent drive means comprises:

(a) a plurality of reversible electric motors mounted one to each carrier arm and drivingly coupled one to each internally screw-threaded sleeve; and (b) a plurality of torque limiters connected one between each motor and one associated sleeve.

7. The invention of claim 5 wherein the joint drive means comprises:

(a) a plurality of reversible electric motors mounted to the rotary shaft and drivingly coupled one to each screw-threaded rod; and (b) a plurality of torque limiters connected one between each motor and one associated rod.

8. In a web supply mechanism in a rotary printing press, wherein a plurality of webs of paper or like printable material in roll form can be held for successive delivery to a printing section by being spliced one to the next, each web roll having a hollow core, in combination:

frame means;

a shaft mounted to the frame means for rotation about a fixed axis thereof;

a plurality of pairs of opposing carrier arms mounted to the shaft, respective ones of each pair of opposing carrier arms being mounted for independent travel axially relative to each other and constrained to joint rotation with the shaft, each pair of carrier arms being disposed opposite each other axially of the shaft for holding one web roll therebetween;

a pair of expansion chucks rotatably mounted respectively to each pair of carrier arms for supporting a web roll therebetween so as to permit rotation of the web roll relative to the carrier arms, each expansion chuck comprising a chuck body capable of insertion in the hollow core of each web roll, and a plurality of struts movable radially of the chuck body into and out of abutment against the inside surface of the hollow core of the web roll;

a chuck actuator mounted to each carrier arm for causing the struts of one expansion chuck to move into and out of abutment against the inside surface of the hollow core of the web roll;

independent drive means for independently moving each pair of carrier arms toward and away from each other; and joint drive means separate from the independent drive means for jointly moving each pair of carrier arms in either of opposite directions axially of the shaft.

9. The invention of claim 8 wherein each expansion chuck further comprises a cam slidably engaged with the struts to cause radial travel thereof relative to the chuck body into and out of abutment against the inside surface of the hollow core of the web roll.

10. The invention of claim 9 wherein each chuck actuator comprises:

a fluid actuated cylinder mounted to one carrier arm; and a drive spindle rotatably extending through a piston of the fluid actuated cylinder and constrained to joint linear reciprocation therewith;

the cam of each expansion chuck being formed on the drive spindle.

11. In a web supply mechanism in a rotary printing press, wherein a plurality of pairs of opposing carrier arms are mounted to a rotary shaft with respective ones of each pair of opposing carrier arms being mounted for independent travel axially relative to each other while being constrained to joint rotation with the shaft, each pair of carrier arms being capable of rotatably holding therebetween a web of paper or like printable material in roll form, a method of holding a web roll between each pair of carrier arms in a preassigned working position in the longitudinal direction of the rotary shaft, which method comprises:

moving one pair of carrier arms to prescribed "ready" positions on the rotary shaft, where the pair of carrier arms are spaced from each other a greater distance than the axial dimension of a web roll to be mounted therebetween;

placing the web roll between the pair of carrier arms being held in the "ready" positions;

moving the pair of carrier arms toward each other, from the "ready" to "mount" positions on the rotary shaft;

rotatably mounting the web roll between the pair of carrier arms being held in the "mount" positions; and jointly moving the pair of carrier arms, by structure separate from the structure mounting the carrier arms for independent travel, together with the web roll mounted therebetween, in either of the opposite longitudinal directions of the rotary shaft until the web roll comes to the preassigned working position.

12. In a web supply mechanism in a rotary printing press, wherein a plurality of pairs of carrier arms are mounted to a rotary shaft for independent travel axially thereof while being constrained to joint rotation therewith, each pair of carrier arms being capable of rotatably holding therebetween a web of paper or like printable material in roll form, a method of holding a web roll between each pair of carrier arms in a preassigned working position in the longitudinal direction of the rotary shaft, which method comprises:

moving one pair of carrier arms to prescribed "ready" positions on the rotary shaft, where the pair of carrier arms are spaced from each other a greater distance than the axial dimension of a web roll to be mounted therebetween;

placing the web roll between the pair of carrier arms being held in the "ready" positions;

moving the pair of carrier arms toward each other, from the "ready" to "mount" positions on the rotary shaft;

rotatably mounting the web roll between the pair of carrier arms being held in the "mount" positions; and jointly moving the pair of carrier arms, together with the web roll mounted therebetween, in either of the opposite longitudinal directions of the rotary shaft until the web roll comes to the preassigned working position; and after rotatably mounting the web roll between the pair of carrier arms:

measuring the distance between one of the carrier arms and the one end of the web roll; and readjusting the position of the web roll according to the measured distance by jointly moving the pair of carrier arms together with the web roll mounted therebetween.

13. In a web supply mechanism in a rotary printing press, wherein a plurality of pairs of carrier arms are mounted to a rotary shaft for independent travel axially thereof while being constrained to joint rotation therewith, each pair of carrier arms being capable of rotatably holding therebetween a web of paper or like printable material in roll form, a method of holding a web roll between each pair of carrier arms in a preassigned working position in the longitudinal direction of the rotary shaft, which method comprises:

moving one pair of carrier arms to prescribed "ready" positions on the rotary shaft, where the pair of carrier arms are spaced from each other a greater distance than the axial dimension of a web roll to be mounted therebetween;

placing the web roll between the pair of carrier arms being held in the "ready" positions;

moving the pair of carrier arms toward each other, from the "ready" to "mount" positions on the rotary shaft;

rotatably mounting the web roll between the pair of carrier arms being held in the "mount" positions;

jointly moving the pair of carrier arms, together with the web roll mounted therebetween, in either of the opposite longitudinal directions of the rotary shaft until the web roll comes to the preassigned working position; and after rotatably mounting the web roll between the pair of carrier arms:

measuring the distances between the carrier arms and the opposite ends of the web roll;

computing the possible displacement of the web roll from a central position between the pair of carrier arms by the equation $$X=(U+U')/2-U$$

or $$X=(U+U')/2-U'$$

where

X=the possible displacement of the web roll from the central position between the pair of carrier arms, U=the measured distance between one carrier arm and the one end of the web roll, and U'=the measured distance between the other carrier arm and the other end of the web roll; and readjusting the position of the web roll by jointly moving the pair of carrier arms in either of the opposite longitudinal directions of the rotary shaft over a distance determined by the computed displacement X.

* * * * *